United States Patent [19]

Sundqvist

[11] 4,155,805

[45] May 22, 1979

[54] METHOD FOR CONTINUOUSLY DIGESTING CELLULOSIC FIBER BY EVENLY SPREADING THE FIBER MATERIAL OVER THE DIGESTION VESSEL WITH STEAM

[75] Inventor: Herbert Sundqvist, Karlstad, Sweden

[73] Assignee: Kamyr Aktiebolag, Karlstad, Sweden

[21] Appl. No.: 871,111

[22] Filed: Jan. 19, 1978

[51] Int. Cl.[2] ..... D21C 7/10

[52] U.S. Cl. ..... 162/17; 162/52; 162/68; 162/250

[58] Field of Search ..... 162/68, 246, 52, 17, 162/46, 250, 237; 214/17 C

[56] References Cited

U.S. PATENT DOCUMENTS

| | | | |
|---|---|---|---|
| 258,400 | 5/1882 | Frambach | 162/68 |
| 850,384 | 4/1907 | Mallam | 162/246 |
| 1,075,795 | 10/1913 | Stanley | 162/246 |
| 1,813,205 | 7/1931 | Scholz et al. | 162/246 |
| 2,858,213 | 10/1958 | Durant et al. | 162/237 |
| 2,901,039 | 8/1959 | Salmonson | 162/246 |
| 3,308,011 | 3/1967 | Ross | 162/68 |
| 3,448,002 | 6/1969 | Bryce et al. | 162/68 |
| 3,532,594 | 10/1970 | Richter | 162/19 |
| 3,785,920 | 1/1974 | Johansen | 162/237 |
| 3,802,956 | 4/1974 | Backlund | 162/19 |

FOREIGN PATENT DOCUMENTS 731046 3/1966 Canada.

*Primary Examiner*—S. Leon Bashore
*Assistant Examiner*—Steve Alvo
*Attorney, Agent, or Firm*—Cushman, Darby & Cushman

[57] ABSTRACT

A method for continuously digesting cellulosic fiber material so that the digested pulp has a very low quantity of reject material (i.e. one to two percent) compared to the prior art. Fiber material is continuously fed into a standing vessel downwardly through the vessel steam phase to establish a fiber level, digesting liquid being added to the vessel to maintain a liquid level therein, and the digested pulp being withdrawn from the bottom of the vessel. Spreading of the downwardly flowing fiber material in the steam phase substantially evenly over the vessel cross-section is effected and the downwardly flowing fiber material is heated by introducing a major portion of the steam to be introduced into the steam phase at a first vertical position about 0.0 to 100 cm. above the higher of the fiber and liquid levels in the vessel.

5 Claims, 3 Drawing Figures

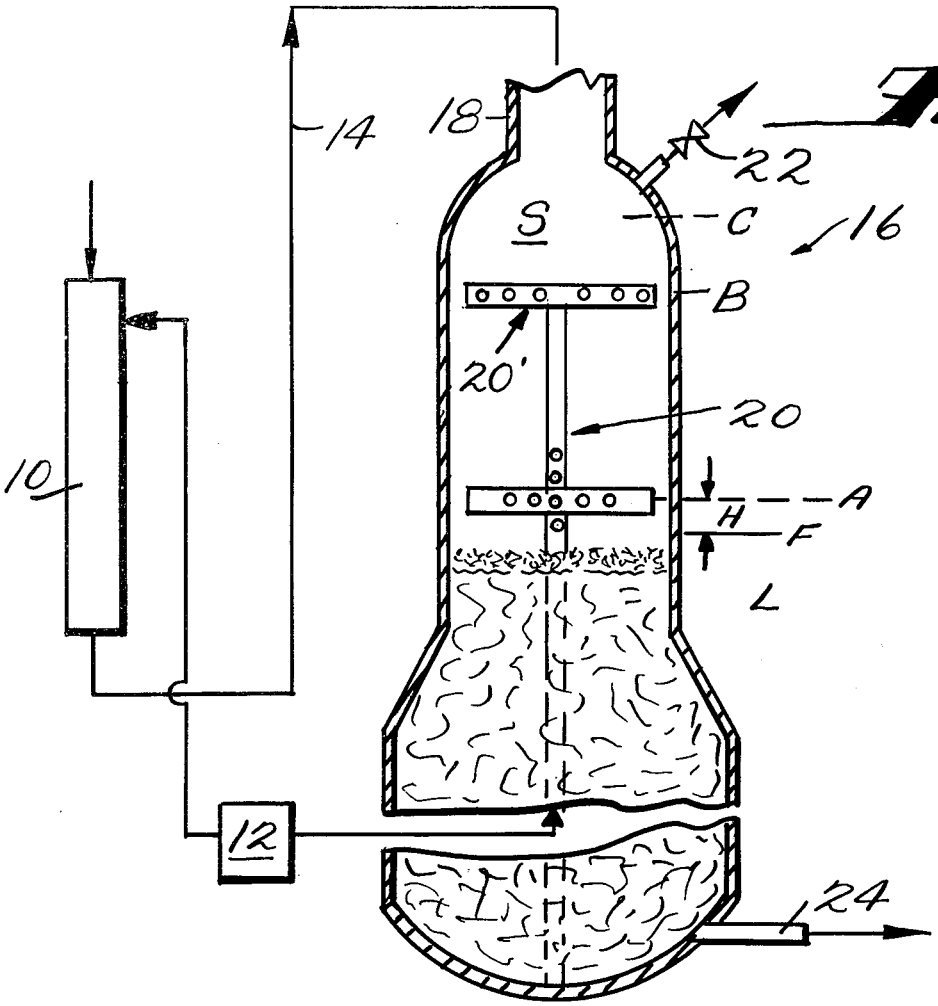
Fig. 1.
Fig. 2a.
PRIOR ART
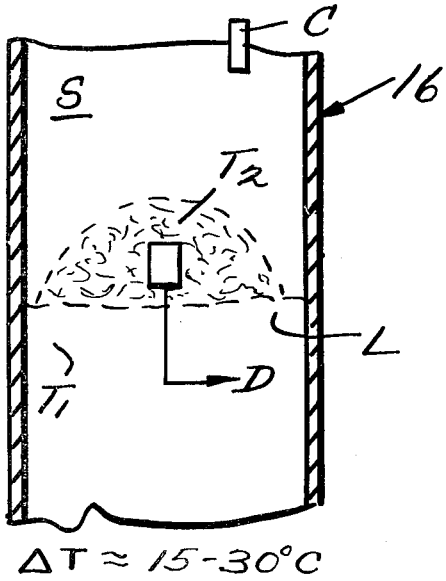
Fig. 2b
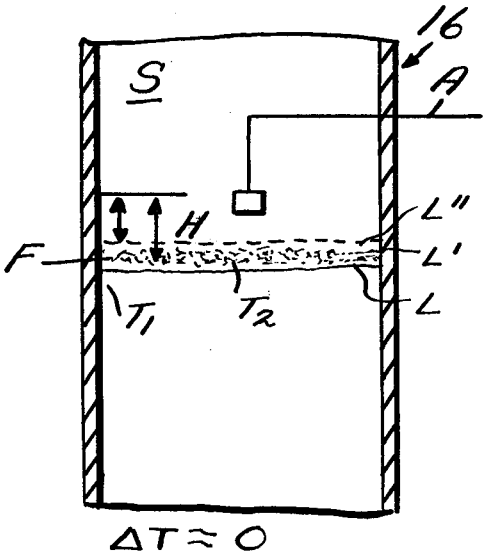

METHOD FOR CONTINUOUSLY DIGESTING CELLULOSIC FIBER BY EVENLY SPREADING THE FIBER MATERIAL OVER THE DIGESTION VESSEL WITH STEAM

BACKGROUND AND SUMMARY OF THE INVENTION

The invention relates to a method of the continuous digesting of cellulosic fiber material (i.e. wood chips or other finely commuted raw material for pulp production). In particular, the method of the invention is directed to continuous cooking methods wherein the heat necessary to bring the fiber material up to process temperature is provided by direct or indirect steam addition to a digester vessel at super atmospheric pressure.

Conventional continuous digesters having a steam phase at the top thereof are disclosed in U.S. Pat. Nos. 3,532,594 and 3,802,956. In such conventional structures, normally an impregnation vessel is provided in which a steam zone is maintained at the top of the vessel, the steam being added to the vessel above the liquid level therein but under the fiber material level therein (see conduit 19 in U.S. Pat. No. 3,532,594) in order to expel the air from the fiber material, which air is then released at the top of the vessel. After this pretreatment, the fiber material is fed to the top of a digester vessel in which a steam phase is also maintained above the level of fiber material and cooking liquid. Conventionally, steam for further heating of the fiber material is added in the steam phase of the digester vessel at the top of the digester vessel (see line 61 in U.S. Pat. No. 3,802,956). Steam which is consumed by condensation on the introduced fiber material (which is colder) is continuously replaced by added new steam so that at all times a steam phase is maintained in the digester top.

In such prior art structures, there is a tendency for the heating of the steam to be uneven across the digester cross-section, which is a great disadvantage in the digesting process since the degree of delignification is strongly dependent upon the temperature. Portions of the fiber material which are subjected to too much heat can be overcooked while portions which receive too little heat will be undercooked and will come out as reject material when screening of the digested pulp which has been removed from the digester takes place. Thus, the yield of suitable pulp per unit of fiber material is not as great as desired. One reason for this uneven heating is the tendency for the fiber material to form a pile configuration in the digester vessel.

According to the present invention, a method for continuously digesting cellulosic fiber material is provided wherein the amount of reject material in the digested pulp can be greatly reduced, thus increasing yield calculated on quantity of introduced fiber material. According to the method of the present invention, a standing vessel having a fiber level therein, a liquid level therein, and a steam phase above the fiber and liquid levels is provided. The method comprises the steps of continuously feeding cellulosic fiber material into the vessel downwardly through the steam phase to establish the fiber levels, and continuously feeding the material downwardly in the vessel; adding digesting liquid into the vessel to maintain the liquid level therein; effecting spreading of the downwardly falling fiber material in the steam phase over the vessel cross-section and feeding the downwardly falling fiber material in the steam phase by introducing a major portion of the steam to be introduced into the steam phase at a first vertical position about 0.0 to 100 cm. above the higher of the fiber and liquid levels in the vessel; and withdrawing digested pulp from the bottom of the vessel. The withdrawn digested pulp has less than about two percent reject material as compared to ten to twelve percent which is common in the prior art. The spreading and heating step is accomplished by spreading the fiber material so that it is substantially evenly distributed over the vessel cross-section so that the configuration of the fiber level in the vessel is substantially a horizontal plane. This may be accomplished by addition of steam above the first vertical position, at a second vertical position, to initially effect the spreading, the substantial portion of the heating being accomplished by the steam introduced at the first vertical position countercurrent to the fiber material flow.

It is the primary object of the present invention to provide a method for digesting cellulosic fiber material in a digesting vessel having a steam phase which has a low level of reject material in the digested pulp withdrawn from the digester. This and other objects of the invention will become clear from an inspection of the detailed description of the invention, and from the appended claims.

BRIEF DESCRIPTION OF THE DRAWINGS

FIG. 1 is a schematic showing of apparatus utilizable for practicing the method of the invention;

FIG. 2*a* is a schematic showing of the fiber level in prior art digesters with steam phases; and FIG. 2*b* is a schematic showing of the fiber level in a digester according to the invention.

DETAILED DESCRIPTION OF THE INVENTION

Cellulosic fiber material is added to a conventional standing impregnation vessel 10 wherein it is steamed (from source 12), and then is fed via line 14 to the top of a conventional continuous digester (i.e. a Kamyr digester such as shown in U.S. Pat. Nos. 3,532,594 and 3,802,956) 16. The fiber inlet 18 for the fiber material is centrally located in the digester top, the fiber material falling down through the inlet 18 into the digester 16 to establish a fiber level F in the digester. A liquid level L of digesting liquid is also maintained in the vessel 16. According to the invention, this liquid level L can be below, at (see L' in FIG. 2*b*), or above (see L'' in FIG. 2*b*) the fiber level F, although under normal circumstances it will be slightly below the fiber level F. According to the present invention steam is added to the steam phase S above the fiber and liquid levels F,L by pipe means, such as the structure indicated generally schematically at 20 in FIG. 1. The added steam will normally be at the desired process temperature (i.e. 150°-170° C.). According to the present invention, a major portion of the steam added by the pipe means 20 is added at a first vertical position A which is close to but above the higher of the fiber and liquid levels F,L. The position A is preferably about 0.0 to 100 cm. above the higher of the levels F,L (the distance H in FIGS. 1 and 2 is about 0.0 to 100 cm.).

The pipe means 20 may take a wide variety of configurations. For instance the pipe means 20 may comprise a pipe which penetrates the digester wall and which ends at the center of the digester cross-section, the pipe having a fully open outlet opening which points downwardly, or—preferably—has a closed opening, the steam being released generally radially through a series of holes or outlet nozzles provided on the lower part of the pipe (i.e. within 0.0 to 50 cm. from the lower end of the pipe). The pipe means also can in certain circumstances be combined with the central pipe for introduction of liquid in a Kamyr digester. For instance, a liquid pipe may be provided having a smaller diameter than the steam pipe and concentric with the steam pipe, the liquid pipe leading down to the liquid and maintaining it at level L in the vessel 16. The holes or nozzles for the steam addition can be constructed so that the outflowing steam practically covers the whole digester cross-section so that the falling fiber material is spread substantially evenly over the entire cross-section of the vessel 16 so that the configuration of the fiber level is substantially a horizontal plane. Alternatively, the pipe means 20 can be introduced at a lower part of the digester and extend upwardly therefrom, ending above the material level F (as shown schematically in FIG. 1). Further, it is also possible to provide several pipes generally symmetrically arranged around the center of the digester cross-section—this may be accomplished utilizing known steam jets of particular shape, which overlap in the horizontal dimension.

Any suitable configuration of the pipe means 20 may be provided which effects spreading of the downwardly flowing fiber material over the vessel cross-section and heats the fiber material to the desired process temperature. Steam introduced at the first level A which is not condensed immediately is driven upwardly in the digester 16 countercurrently to the falling fiber material, heating the fiber material and displacing heavier gases from the steam phase S so that the steam obtains better accessibility to the fiber material individual components. The upwardly driven gases are released through an adjustable outlet 22.

According to the present invention not all of the steam need be added at the first vertical level A but rather some of the steam may be added at a second vertical level B, or at a third vertical level C. Steam added at second vertical level B may be added by pipe means 20' disposed vertically above the position A. For instance, the position B may be approximately halfway between the position A and the digester inlet 18. Steam added at position B substantially effects spreading of the fiber material over the vessel cross-section, while the majority of the heating of the steam takes place by the steam introduced at position A, the steam introduced at position A contacting the spread out fiber material so that maximum accessibility thereto is provided.

Alternatively, some of the steam (i.e. 0 to 50%) added to the steam phase S can be added in the conventional manner at the top of the digester 16 (at a third vertical position C), while the remaining steam is added at the position A.

FIG. 2*a* shows diagrammatically a fiber pile formed in the practice of prior art methods such as shown in U.S. Pat. Nos. 3,532,594 and 3,802,956. In such a pile configuration, in practice relatively large temperature differentials ($\Delta T$) of as much as 15° to 30° C. are present between the fiber material at the peripheral portions (T1) and in the central portion of the column (T2). Such a $\Delta T$ of 15° to 30° C. can lead to ten to twelve percent reject material in the digested pulp withdrawn through conduit 24 from the bottom of digester 16, unless the temperature is adequately adjusted in the digester liquid zone by means of a continuous, even liquid circulation. The same adverse results can occur if the steam is added to the digester 16 at a vertical position D (see FIG. 2*a*) under the fiber material level but above the liquid level L.

In contradistinction to the prior art, however, according to the present invention—as exemplified in FIG. 2*b*—the fiber material assumes a configuration such that it is substantially a horizontal plane, the fiber material having been spread out by introduction of steam at positions A and/or B, heavy gases which are produced being driven away so that the steam obtains good access to the fiber pieces for an even heating thereof. In such a situation, $\Delta T$ (T1−T2) is substantially 0, and the digested pulp produced according to the method of the invention has only about one to two percent reject material therein.

It is noted that the method according to the present invention is utilizable with all types of standing (i.e. vertical and sloping) continuous digesters with direct heating in a steam phase, and also is applicable to all vessels with comparable conditions (vessels for partial delignification or pretreatment in connection with multistage processes).

Thus, according to the present invention, a method has been provided that effects even spreading and heating of downwardly falling fiber material in a steam phase with consequent reduction in the amount of reject material in the pulp so produced. While the invention has been herein shown and described in what is presently conceived to be the most practical and preferred embodiment, it will be apparent to those of ordinary skill in the art that many modifications may be made thereof within the scope of the invention, which scope is to be accorded the broadest interpretation of the appended claims so as to encompass all equivalent processes and methods.

What is claimed is:

1. A method for continuously digesting cellulosic fiber in a standing vessel having a fiber level therein, a liquid level therein, and a steam phase above the fiber and liquid levels, comprising the steps of continuously feeding cellulosic fiber material into the vessel downwardly through the steam phase to establish the fiber level, and continuously feeding the material downwardly in the vessel;

adding digesting liquid into the vessel to maintain the liquid level therein;

effecting heating to the desired process temperature of the downwardly falling material in the steam phase by continuously introducing a major portion of the steam to be introduced into the steam phase at a first vertical position countercurrent to the fiber material flow, the first vertical position being about 0 to 100 centimeters above the higher of the fiber and liquid levels in the vessel, wherein the steam added at the first position which remains uncondensed is immediately driven upwardly in the digester countercurrently to the falling material while displacing heavier gases formed, and said upwardly driven steam is exhausted at the top of the vessel simultaneously with the feeding of steam to the steam phase;

substantially evenly spreading the fiber material over the vessel cross-section, so that the ultimate configuration of the fiber level is substantially a horizontal plane, by continuously introducing a quantity of steam into the steam phase at a second vertical position above the first vertical position; and continuously withdrawing digested pulp from the bottom of the vessel.

2. A method as recited in claim 1 wherein said heating and spreading steps are accomplished by introducing steam into the steam phase through pipe means which extend axially in the vessel.

3. A method as recited in claim 1 wherein the steam added to the steam phase at the first vertical position is generally radially directed.

4. A method as recited in claim 1 wherein the steam added to the stream phase at the first vertical position is generally downwardly directed.

5. A method as recited in claim 1 wherein the fiber level in the vessel is established higher than the liquid level.

* * * * *